US009605584B2

(12) United States Patent
Nethercutt

(10) Patent No.: US 9,605,584 B2
(45) Date of Patent: Mar. 28, 2017

(54) METHOD AND SYSTEM TO DIAGNOSE THERMOSTAT FAILURE IN ENGINE WITH ONBOARD DIAGNOSTICS

(71) Applicant: Cummins Inc., Columbus, IN (US)

(72) Inventor: Jeremiah Nethercutt, Morgantown, IN (US)

(73) Assignee: Cummins Inc., Columbus, IN (US)

( * ) Notice: Subject to any disclaimer, the term of this patent is extended or adjusted under 35 U.S.C. 154(b) by 184 days.

(21) Appl. No.: 14/072,112

(22) Filed: Nov. 5, 2013

(65) Prior Publication Data

US 2014/0123918 A1 May 8, 2014

Related U.S. Application Data

(60) Provisional application No. 61/723,719, filed on Nov. 7, 2012.

(51) Int. Cl.

| | |
|---|---|
| ***G01M 15/04*** | (2006.01) |
| ***F01P 7/16*** | (2006.01) |
| ***F01P 11/16*** | (2006.01) |

(52) U.S. Cl.

CPC ..... *F01P 7/16* (2013.01); *F01P 11/16* (2013.01); *F01P 2031/32* (2013.01)

(58) Field of Classification Search

USPC ..... 73/114.68, 114.77

See application file for complete search history.

(56) References Cited

U.S. PATENT DOCUMENTS

| | | | | |
|---|---|---|---|---|
| 6,161,767 | A * | 12/2000 | Yeo | 236/94 |
| 6,279,390 | B1 * | 8/2001 | Oka et al. | 73/114.68 |
| 6,732,025 | B2 * | 5/2004 | Reese et al. | 701/31.9 |
| 7,261,067 | B2 * | 8/2007 | Kim | 123/41.15 |
| 7,363,804 | B2 * | 4/2008 | Wakahara et al. | 73/114.68 |
| 8,770,834 | B2 * | 7/2014 | Suzuki | 374/1 |
| 8,839,665 | B2 * | 9/2014 | Nishigaki | 73/114.68 |
| 2002/0088274 | A1 * | 7/2002 | Oka et al. | 73/118.1 |
| 2002/0099482 | A1 * | 7/2002 | Reese et al. | 701/29 |
| 2002/0157620 | A1 * | 10/2002 | Kastner et al. | 123/41.1 |
| 2005/0224019 | A1 * | 10/2005 | Kim | 123/41.1 |
| 2007/0034172 | A1 * | 2/2007 | Miyahara et al. | 123/41.1 |
| 2010/0116228 | A1 * | 5/2010 | Fujimoto | 123/41.1 |
| 2010/0138134 | A1 * | 6/2010 | Anilovich et al. | 701/102 |
| 2012/0033705 | A1 * | 2/2012 | Wiltsch | 374/1 |
| 2012/0085157 | A1 * | 4/2012 | Nishigaki | 73/114.68 |
| 2012/0106590 | A1 * | 5/2012 | Suzuki | 374/1 |
| 2014/0023107 | A1 * | 1/2014 | Furuta et al. | 374/4 |

* cited by examiner

*Primary Examiner* — Eric S McCall
(74) *Attorney, Agent, or Firm* — Foley & Lardner LLP

(57) ABSTRACT

A system includes an internal combustion engine having a thermostat provided to selectively allow coolant flow through the engine, and a coolant temperature determination device that provides a coolant temperature value. The system further includes a controller structured to functionally execute operations to diagnose the thermostat. The controller determines whether the engine is providing a high output operation. When the engine is providing a high output operation, the controller determines the thermostat is passed in response to the coolant temperature value exceeding a first threshold temperature value.

18 Claims, 6 Drawing Sheets

METHOD AND SYSTEM TO DIAGNOSE THERMOSTAT FAILURE IN ENGINE WITH ONBOARD DIAGNOSTICS

CROSS-REFERENCE TO RELATED PATENT APPLICATIONS

This application claims priority from U.S. Provisional Application No. 61/723,719, filed Nov. 7, 2012, the contents of which are incorporated herein by reference in its entirety.

FIELD OF THE INVENTION

The present invention relates generally to engines with on board diagnostics and more particularly to detecting thermostat failure in such engines.

BACKGROUND

Presently know operations to detect a failed thermostat operate only at initial engine start, and/or may detect a false failure when an engine is operating at a low power condition. Accordingly, improvements in this technical area are indicated.

SUMMARY

By bounding engine operation into two categories (low power operation, which may cause coolant temperature to drop, and high power operation, which will always keep coolant temperature above some minimum threshold), a diagnostic can be created to detect that, when engine is in "high power" area of operation, coolant temperature should be either rising, or fully warmed-up. When in "high power" operation, if coolant temperature is either dropping, or has leveled-off at some temperature significantly lower then thermostat-open temperature, then it can be concluded that the thermostat is either partially or fully stuck open, has been compromised, or fully removed.

DETAILED DESCRIPTION

The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 1:
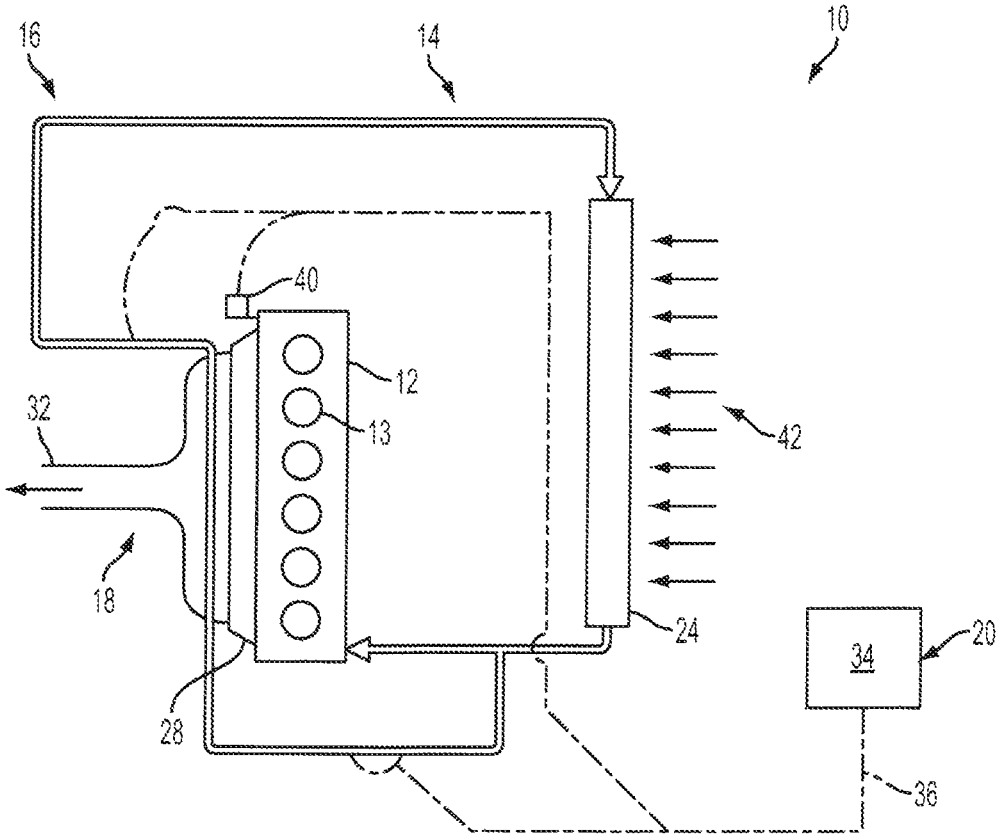
FIG. 1 is a schematic of a first example embodiment of the present disclosure.

Referring now to FIG. 1, an internal combustion engine 10 incorporating a first example embodiment of the present disclosure may include an engine body or block 12, a cooling fluid circuit 14 to direct cooling fluid or coolant through engine body 12, a pumping system 16 to pump cooling fluid through engine body 12, an exhaust system 18, and a control system 20.

Cooling fluid circuit 14 may include a radiator 24, which may be a heat exchanger or cooler. Exhaust system 18 may include an exhaust manifold 28, and a downstream flow path 32. Control system 20 may include a control module 34, a wire harness 36, and a temperature sensor 40.

Control module 34 may be an electronic control unit of electronic control module (ECM) that monitors the performance of engine 10 or may monitor other vehicle conditions. Control module 34 may be a single processor, a distributed processor, an electronic equivalent of a processor, or any combination of the aforementioned elements, as well as software, electronic storage, fixed lookup tables and the like. Control module 34 may connect to certain components of engine 10 by wire harness 36, though such connection may be by other means, including a wireless system. Control module 34 may include a digital or analog circuit.

In a system and method in accordance with an embodiment by bounding engine operation into two categories (low power operation, which may cause coolant temperature to drop, and high power operation, which will always keep coolant temperature above some minimum threshold), a thermostat failure detection diagnostic located typically within the control module 34 can be created to detect that, when engine is in "high power" area of operation, coolant temperature should be either rising, or fully warmed-up. When in "high power" operation, if coolant temperature is either dropping, or has leveled-off at some temperature significantly lower than thermostat-open temperature, then it can be concluded that the thermostat is either partially or fully stuck open, has been compromised, or fully removed.

A system that utilizes a thermostat failure detection algorithm in accordance with the present invention can take the form of an entirely hardware implementation, an implementation including computer instructions stored on a non-transient computer readable memory, or an implementation including mixtures thereof.

Furthermore, the thermostat failure detection algorithm can take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk, and an optical disk. Current examples of optical disks include DVD, compact disk-read-only memory (CD-ROM), and compact disk-read/write (CD-R/W). To describe the features of the present invention in more detail, refer now to the following description in conjunction with the accompanying Figures.

Figure 2:
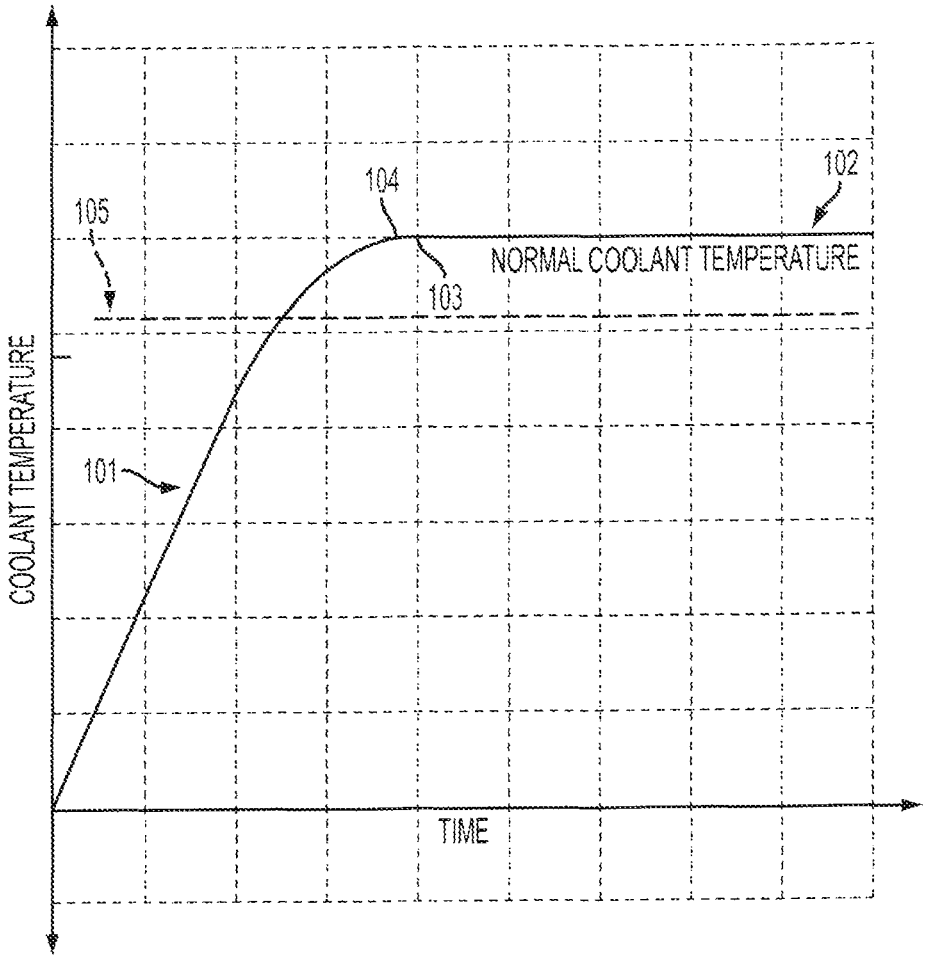
FIG. 2 shows a coolant temperature trend from a healthy engine.

A healthy engine, when cold-soaked overnight and operated with a significant duty cycle, will show a coolant temperature trend similar to line sections 101-102 in FIG. 2. Line section 101 shows a warm-up portion of coolant temperature, as fuel burned in-cylinder heats engine block jacket coolant. At some point (104), the thermostat will open, and regulate engine coolant temperature by allowing coolant flow to the vehicle's radiator (coolant to ambient air 42 heat exchanger). At this point, a healthy thermostat will maintain a fairly constant coolant temperature for the rest of most vehicle operation cycles (line section 102).

Should the thermostat stick open, a trend in coolant temperature such as that shown in 103 may be observed. This may, or may not be indicative of a failed thermostat.

It is understood how to successfully diagnose failure modes in region represented by line section 101, but have to this date, had no thermostat diagnostics in region represented by line section 102. The difficulty in determining a failure in this operation mode (103), is that the nature of a diesel engine (reciprocating ½ of its engine displacement in ambient air every crank revolution) tends to drive significantly lower engine block temperature when left at idle in cold ambient air temperature conditions. This will mean that a healthy engine, operated in low power (low heat rejection to coolant) will result in a trend similar to 103, although the thermostat is operating as designed.

To distinguish between a normal drop in coolant temperature, and an unexpected drop in coolant temperature, an embodiment of the present diagnostic will take either in-cylinder combusted fuel delivery, or estimated torque production as inputs to the diagnostic. Additionally or alternatively, the diagnostic will take ambient air temperature as an input to the diagnostic.

Figure 3A:
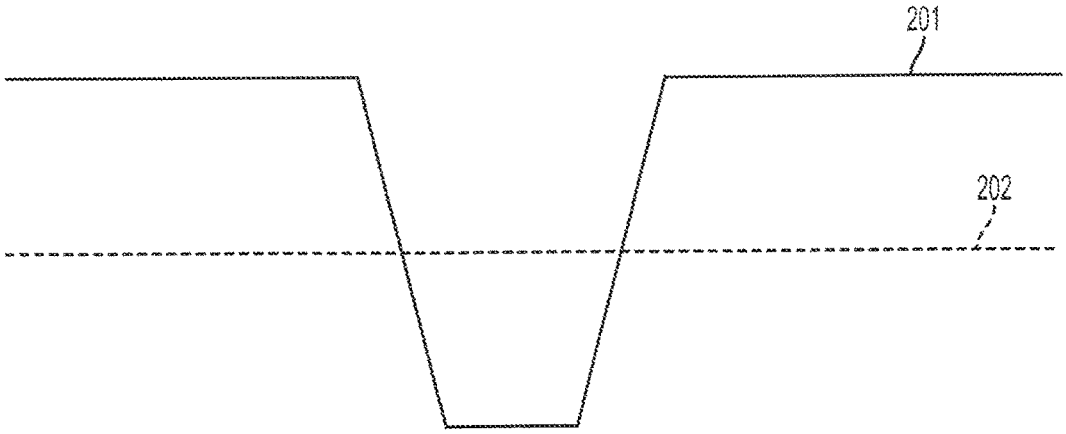
FIG. 3A shows illustrative data of coolant temperature for an engine having a properly operating thermostat at a low ambient temperature, low load condition.

Referencing FIG. 3A, when coolant temperature has risen above a calibratable threshold, the diagnostic will declare a passing decision. Referencing FIG. 3B, when coolant temperature fails to rise for a significant amount of time spent with high fueling or torque, and/or at an ambient temperature above a calibratable threshold value, the diagnostic sets a fault, diagnosing a failed thermostat.

Figure 3B:
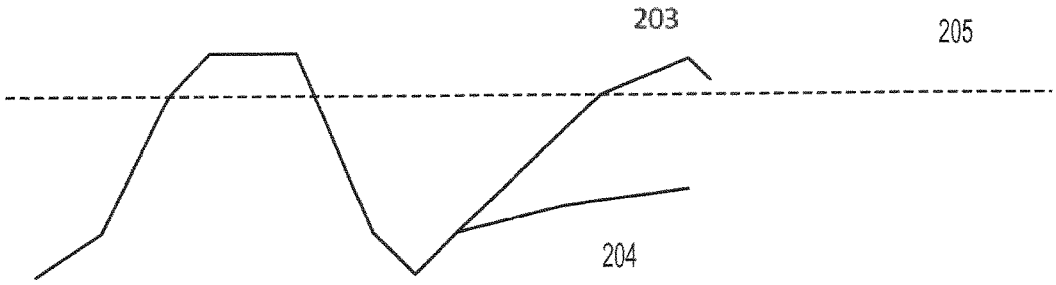
FIG. 3B shows illustrative data of coolant temperature for an engine having a failed thermostat operating at a high load condition.

Referring to FIGS. 3A and 3B together, when coolant temperature is lower than some threshold (based, for example, on the thermostat regulation temperature used on the engine) (105) (205), if fueling/torque (201) is above some calibratable threshold (202), and/or if ambient temperature is above a calibratable threshold, then coolant temperature is expected to be rising, or to have risen above a fixed threshold (105) (205). Failure of coolant temperature to rise for a significant amount of time spent with high fueling or torque, and/or with ambient air temperature exceeding a threshold, will cause the diagnostic to set a fault, diagnosing a failed thermostat (204). When coolant temperature has risen above a calibratable threshold (105/205), the diagnostic will declare a passing decision (203). To describe this algorithm in more detail refer now to FIG. 4.

Figure 4:
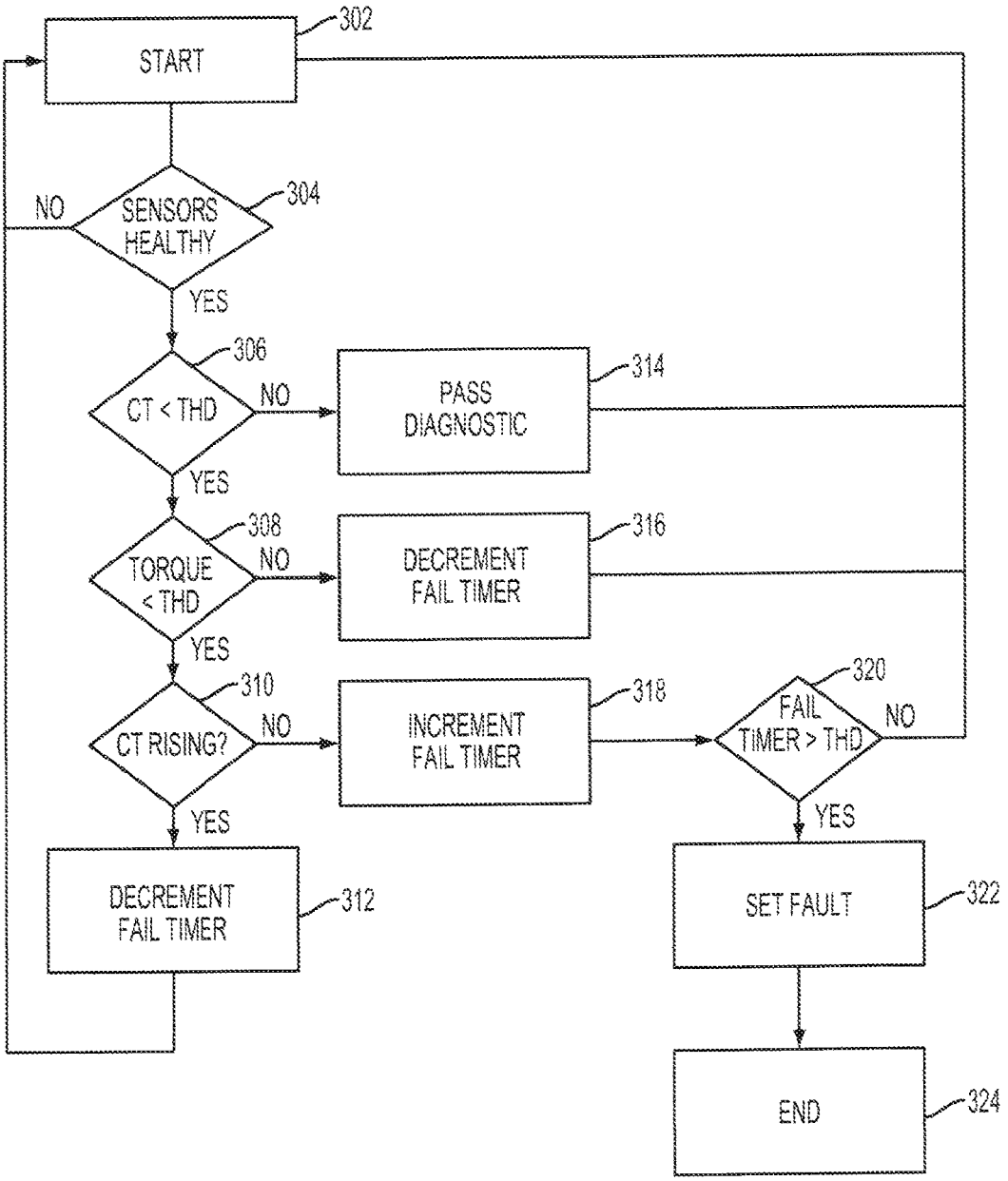
FIG. 4 is a schematic flow diagram of the operation of a thermostat failure detection algorithm in accordance with an embodiment.

FIG. 4 is a flow chart of the operation of a thermostat failure detection algorithm in accordance with an embodiment. First, after thermostat failure algorithm is started, via step 302, it is then determined if the sensors are healthy, via step 304. An example operation to determine if the sensors are healthy includes determining whether a relevant sensor presently is in a fault condition, and/or if a backup sensor is acceptable to proceed with the diagnostic operation if the primary sensor has a fault. If it is determined that the sensors are healthy, via step 304, it is then determined if the coolant temperature is less than a threshold, via step 306. If the coolant temperature is not less than that threshold then the diagnostic indicates that the thermostat is operating properly, via step 314 and return to step 302. Operation 306 may additionally or alternatively include a check (not shown) to determine whether an ambient temperature is below a threshold value. In certain embodiments, a sufficiently high ambient temperature may provide a coolant temperature value high enough to mask a failed thermostat. In certain embodiments, the operating 306 may be checked to determine whether a previously passed sensor remains in a passed condition, and to determine that a previously failed sensor is now passed if the ambient temperature is also below a threshold value.

If on the other hand, it is determined that the determined that the coolant temperature is less than the threshold then it is determined if the torque of the engine is less than a predetermined threshold, via step 308. If the torque is less than a predetermined threshold, then it is determined if the coolant temperature is rising, via step 310. If the coolant temperature is rising, then a fail timer is decremented, via step 312, and the process returns to start, via step 302. If the coolant temperature is above a threshold, via step 306, the failure thermostat diagnostic passes, via step 314, and the process concludes and/or returns to start, via step 302. Where the diagnostic process concludes, the diagnostic process may be repeated at any selected interval, including at least periodically, in response to a key on event, in response to a trip detection event, in response to the engine speed-load entering a certain range (e.g. a high load or fueling range), and/or further in response to the engine coolant being lower than a threshold value when the engine speed-load enters the certain range.

If the coolant temperature is determined to be less than the threshold, via step 306, and if the torque is above its threshold, via step 308, then the fail timer is decremented, via step 316, and the process returns to the start, via step 302. If it is determined that torque is below the threshold, via step 308, and if the coolant temperature is not rising, via step 310, then the fail timer is incremented, via step 318.

If the value of the fail timer is above a threshold, via step 320, then a fault is set, via step 322. If the fail timer is below the threshold, the process returns to the start, via step 302. In certain embodiments, if the value of the fail timer exceeds the threshold, via operation 320, then a fault value may be incremented, and when the fault value is incremented a set number of times then thermostat fault is set and the method may end at step 324. Any of the "pass diagnostic" operations herein may reset the fault value and/or decrement the fault value toward a passed sensor value.

Accordingly, by bounding engine operation into two categories (low power operation, which may cause coolant temperature to drop, and high power operation, which will always keep coolant temperature above some minimum threshold), and/or by further limiting the diagnostic to appropriate ambient temperature ranges, a thermostat failure detection diagnostic can be created to detect that, when engine is in "high power" area of operation, coolant temperature should be either rising, or fully warmed-up. When in "high power" operation, if coolant temperature is either dropping, or has leveled-off at some temperature significantly lower than thermostat-open temperature, then it can be concluded that the thermostat is either partially or fully stuck open, has been compromised, or fully removed.

Further example embodiments are described following.

In certain embodiments, a system includes a controller (e.g. control module 34) structured to perform certain operations to diagnose a thermostat. In certain embodiments, the controller forms a portion of a processing subsystem including one or more computing devices having memory, processing, and communication hardware. The controller may be a single device or a distributed device, and the functions of the controller may be performed by hardware and/or as computer instructions on a non-transient computer readable storage medium.

In certain embodiments, the controller includes one or more modules structured to functionally execute the operations of the controller. In certain embodiments, the controller includes an engine load determination module, a thermostat diagnostic module, and/or a test conditions module. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or as computer instructions on a non-transient computer readable storage medium, and modules may be distributed across various hardware or computer based components. More specific descriptions of certain embodiments of controller operations are included in the section referencing FIG. 5.

Example and non-limiting module implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

Certain operations described herein include operations to determine one or more parameters. Determining, as utilized herein, includes receiving values by any method known in the art, including at least receiving values from a datalink or network communication, receiving an electronic signal (e.g. a voltage, frequency, current, or PWM signal) indicative of the value, receiving a computer generated parameter indicative of the value, reading the value from a memory location on a non-transient computer readable storage medium, receiving the value as a run-time parameter by any means known in the art, and/or by receiving a value by which the determined parameter can be calculated, and/or by referencing a default value that is determined to be the parameter value.

An example system 10 includes an internal combustion engine 12 having a thermostat (not shown) provided to selectively allow coolant flow through the engine 12. The system 10 further includes a coolant temperature determination device that provides a coolant temperature value. An example coolant temperature determination device includes a temperature sensor that detects coolant temperature at the engine block, or at a position where coolant in the engine block can be estimated or inferred.

An example system further includes a controller structured to functionally execute operations to diagnose the thermostat. The example controller includes a number of modules structured to functionally execute the operations of the controller.

An example system 10 includes the engine 12 being a compression ignition engine, which may further be a direct injected engine. Compression ignition engines do not require a particular air-fuel mixture to burn within the combustion chamber 13. Accordingly, to improve power density, torque capability, and/or emissions performance, compression ignition engines operate with excess air at many operating conditions. At low engine loads, the amount of excess air can be high, causing a low exhaust temperature and low coolant temperature. One of skill in the art, having the benefit of the disclosures herein, will recognize that a thermostat diagnostic can be particularly beneficial for a compression ignition engine.

Figure 5:
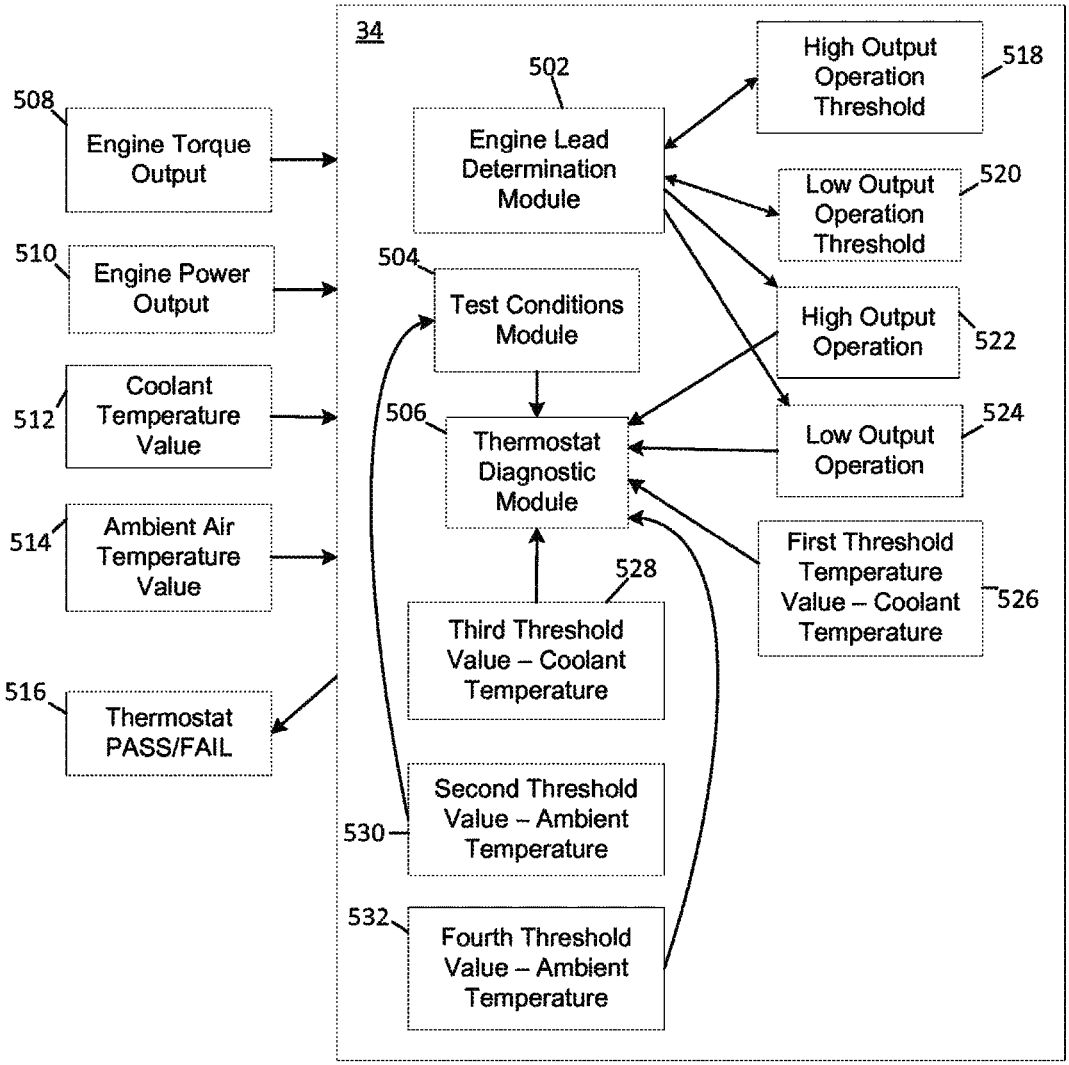
FIG. 5 is a schematic diagram of an apparatus for diagnosing a thermostat.

Referencing FIG. 5, an example controller 34 is depicted schematically. The controller 34 includes an engine load determination module 502 that determines whether the engine is providing a high output operation 522. An example engine load determination module 502 determines an engine output parameter, for example an engine torque output 508 and/or engine power output 510, and determines whether the engine output parameter exceeds a high output operation threshold 518 value.

The high output operation threshold 518 value may vary with engine conditions, for example the torque threshold may vary with engine speed. Any engine operating condition that affects the coolant temperature may be utilized as an engine output parameter, for example but not limited to EGR fraction, EGR cooler bypass condition, exhaust manifold temperature, intake manifold temperature, and/or VGT position. In certain embodiments, the engine load determination module 502 further determines whether the engine is providing the high output operation 522 in response to the ambient air temperature value. In certain further embodiments, the engine load determination 502 raises an engine output threshold 518 in response to a decreased ambient air temperature value 514. A decreased ambient air temperature value 514 results in a lower engine out temperature value and a lower coolant temperature value 512. At a lower ambient temperature value 514, a higher engine output value is required to achieve the same coolant temperature value 512, and in certain embodiments the high output operation threshold 518 is adjusted upward in response to the decreased ambient air temperature. One of skill in the art, having the benefit of the disclosures herein, will have expected coolant temperature values for various engine operating conditions readily available when contemplating a particular system, or such values can be taken from standard data generation of the type ordinarily performed. Accordingly, the selection of a high output operation threshold value 518 is a mechanical step for one of skill in the art having the benefit of the disclosures herein.

The example controller 34 further includes a thermostat diagnostic module 506 that determines when the engine 12 is providing a high output operation 522, and in response to the determining the engine 12 is providing the high output operation 522, determines the thermostat is passed (thermostat PASS/FAIL 516 as PASS) in response to the coolant temperature value 512 exceeding a first threshold temperature value 526.

In certain embodiments, the controller 34 further includes a test conditions module 504 that determines the engine 12 is in a low output operation 520, and prevents the diagnostic to determine whether the thermostat has passed in response the engine being in a low output operation 524. An example system includes an ambient air temperature determination device that determines an ambient air temperature value 514, and the test conditions module 504 determining whether the ambient air temperature value 514 is lower than a second threshold temperature value 530. The test conditions module 504 further prevents the diagnostic to determine whether the thermostat has passed in response to the ambient air temperature value 514 being lower than the second threshold temperature value 530.

An example controller 34 further includes the thermostat diagnostic module 506 further determining that the thermostat has failed in response to the engine providing the high output operation 522, and further in response to the coolant temperature 512 being lower than a third threshold value 528, and/or the coolant temperature value failing to rise a calibratable amount within a calibratable time. The calibratable amount and time of the expected coolant temperature rise may be based upon engine operating conditions and/or ambient conditions. An example controller 34 includes the thermostat diagnostic module 506 further determining that the thermostat has failed in response to an ambient temperature value 514 exceeding a fourth threshold value 532.

The schematic flow description which follows provides an illustrative embodiment of performing procedures for diagnosing a thermostat. Operations illustrated are understood to be examples only, and operations may be combined or divided, and added or removed, as well as re-ordered in whole or part, unless stated explicitly to the contrary herein. Certain operations illustrated may be implemented by a computer executing a computer program product on a non-transient computer readable storage medium, where the computer program product comprises instructions causing the computer to execute one or more of the operations, or to issue commands to other devices to execute one or more of the operations.

An example procedure for diagnosing thermostat failure in an engine includes an operation to determine when the engine is providing a high output operation, and in response to the determining the engine is providing the high output operation, operations to determine the temperature of an engine coolant and to determine that a thermostat has passed in response to determining the temperature of the engine coolant exceeds a first temperature threshold value. An example procedure further includes an operation to prevent the diagnosing the thermostat failure in response to determining the engine is in a low output operation. An example high output operation includes a high torque operation and/or a high power operation. An example low output operation includes a low torque and/or a low power operation. An example procedure includes an operation to prevent the diagnosing the thermostat failure in response to determining an ambient temperature value is lower than a second temperature threshold value.

An example procedure includes an operation to determine that the thermostat has failed in response to the engine providing the high output operation, and further in response to the coolant temperature being lower than a third threshold value, and/or the coolant temperature failing to rise a calibratable amount within a calibratable time. An example procedure further includes an operation to determine that the thermostat has failed in response to an ambient temperature value exceeding a fourth threshold value Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the present invention.

What is claimed is:

1. A method for diagnosing thermostat failure in an engine comprising:

determining when the engine is providing a high output operation based on an engine output parameter exceeding a high output operation threshold value, wherein the high output operation threshold value is determined in response to an ambient air temperature value, and in response to the determining the engine is providing the high output operation:

determining the temperature of an engine coolant, and determining that a thermostat has passed in response to determining the temperature of the engine coolant exceeds a first temperature threshold value.

2. The method of claim 1, further comprising preventing the diagnosing of the thermostat failure in response to determining the ambient temperature value is lower than a second temperature threshold value.

3. The method of claim 1, further comprising preventing the diagnosing of the thermostat failure in response to determining the engine is in a low output operation, wherein the low output operation comprises at least one of a low torque operation and a low power operation.

4. The method of claim 3, wherein the high output operation comprises at least one of a high torque operation and a high power operation.

5. The method of claim 1, further comprising determining that the thermostat has failed in response to the engine providing the high output operation based on at least one of: the coolant temperature being lower than a third threshold value, and the coolant temperature failing to rise a calibratable amount within a calibratable time.

6. The method of claim 5, further comprising determining that the thermostat has failed in response to the ambient temperature value exceeding a fourth threshold value.

7. A system, comprising:

an internal combustion engine having a thermostat provided to selectively allow coolant flow through the engine;

a coolant temperature determination device structured to provide a coolant temperature value;

a controller, comprising:

an engine load determination module structured to determine whether the engine is providing a high output operation based on an engine output parameter exceeding a high output operation threshold value, wherein the high output operation threshold value is determined in response to an ambient air temperature value;

a thermostat diagnostic module structured to determine when the engine is providing a high output operation, and in response to the determining the engine is providing the high output operation, determining the thermostat has passed in response to the coolant temperature value exceeding a first threshold temperature value.

8. The system of claim 7, wherein the engine is a direct injected compression ignition engine.

9. The system of claim 7, where the controller further comprises a test conditions module structured to determine the engine is in a low output operation, and to prevent determining whether the thermostat has passed in response the engine in the low output operation, wherein the low output operation comprises at least one of a low torque operation and a low power operation.

10. The system of claim 9, wherein the high output operation comprises at least one of a high torque operation and a high power operation.

11. The system of claim 10, further comprising an ambient air temperature determination device structured to determine the ambient air temperature value, and a test conditions module structured to determine whether the ambient air temperature value is lower than a second threshold temperature value, and to prevent determining whether the thermostat has passed in response to the ambient air temperature value being lower than the second threshold temperature value.

12. The system of claim 11, wherein the thermostat diagnostic module is further structured to determine that the thermostat has failed in response to the engine providing the high output operation, and further in response to one of: the coolant temperature being lower than a third threshold value, and the coolant temperature value failing to rise a calibratable amount within a calibratable time.

13. An apparatus, comprising:

an engine load determination module structured to determine whether an engine is providing a high output operation based on an engine output parameter exceeding a high output operation threshold value, wherein the high output operation threshold value is determined in response to an ambient air temperature value; and a thermostat diagnostic module structured to determine when the engine is providing a high output operation, and in response to the determining the engine is providing the high output operation, determining the thermostat has passed in response to the coolant temperature value exceeding a first threshold temperature value.

14. The apparatus of claim 13, further comprising a test conditions module structured to determine the engine is in a low output operation, and to prevent determining whether the thermostat has passed in response to the engine in the low output operation, wherein the low output operation comprises at least one of a low torque operation and a low power operation.

15. The apparatus of claim 13, wherein the high output operation comprises at least one of a high torque operation and a high power operation.

16. The apparatus of claim 13, further comprising a test conditions module structured to determine whether the ambient air temperature value is lower than a second threshold temperature value, and to prevent determining whether the thermostat has passed in response to the ambient air temperature value being lower than the second threshold temperature value.

17. The apparatus of claim 13, wherein the thermostat diagnostic module is further structured to determine that the thermostat has failed in response to the engine providing the high output operation based on at least one of: the coolant temperature being lower than a third threshold value, and the coolant temperature value failing to rise a calibratable amount within a calibratable time.

18. The apparatus of claim 13, further comprising raising the high output operation threshold value in response to a decreased ambient air temperature value.

* * * * *